United States Patent [19]

Dixon

[11] 4,426,085

[45] Jan. 17, 1984

[54] AUTOMATIC RESETTING TARGET FOR FIREARMS

[76] Inventor: Lawrence Dixon, R.D. #3, Box 3902, Pottsville, Pa. 17901

[21] Appl. No.: 395,140

[22] Filed: Jul. 6, 1982

[51] Int. Cl.[3] ..... F41J 7/04

[52] U.S. Cl. ..... 273/392; 273/375

[58] Field of Search ..... 273/390, 391, 392, 375

[56] References Cited

U.S. PATENT DOCUMENTS 3,064,976 11/1962 Kuhn ..... 273/391 X

FOREIGN PATENT DOCUMENTS 443659 10/1927 Fed. Rep. of Germany ..... 273/392

*Primary Examiner*—Anton O. Oechsle

*Attorney, Agent, or Firm*—Ruth Moyerman

[57] ABSTRACT

An automatic resetting target is disclosed. A box-like housing containing a target holder including a positioning arm which protrudes through the housing lid. A rotating plate with tripping means is linked to a motor. A normally open switch connects the motor and a power source. When the impact of a projectile against a target causes the holder to nutate from an upward to a downward position, the switch is closed causing the tripping means of the rotating plate to engage the target holder's arm returning the holder to an upward position and breaking the circuit.

13 Claims, 6 Drawing Figures

24
20
A
22
46
16
30
12
26
32
18
38
34
36
28
30
40
10
42
48
ON
50
OFF
44
46
48
10
14

AUTOMATIC RESETTING TARGET FOR FIREARMS

BACKGROUND OF THE INVENTION

1. Field of the Invention

This invention relates to a target device and more particularly to an automatic resetting target used in target practice with aerial projectiles.

2. Description of the Prior Art

Many devices are known whose purpose is to function as targets for the avid marksman. The vast majority of these targets, however, do not allow the marksman to change or reuse the target displays and/or require the marksman to manually reset the target.

Because the marksman may have a need to practice shooting targets representing different sizes and shapes of animals, the prior art devices are not practical. U.S. Pat. No. 1,087,507 to Palen and U.S. Pat. No. 2,905,469 to Taylor are examples of noninterchangeable and nonreusable targets, respectively.

A manual resetting target causes the marksman a great deal of inconvenience by interrupting his shooting position. U.S. Pat. No. 1,087,507 to Palen and U.S. Pat. No. 2,029,059 to Cookson are examples of devices which cause such interruptions. Palen's device requires the target to be manually reset by a pull chain. Cookson provides two like targets, both of which must be reset by hand.

Other target devices of the prior art additionally have a great many moving parts that can require more care and expensive repair. Furthermore, none of the prior art devices have a protective housing and, therefore, can be damaged by stray projectiles.

There is, therefore, a great need for a target device which is convenient to operate and allows for a variety of targets that automatically reset themselves.

SUMMARY OF THE INVENTION

The aforementioned prior art problems are overcome by the automatic target device of this invention. The automatic target device of this invention includes a parallelepipedal shaped housing with a target holder protruding through the closed lid's aperture. The target holder includes a positioning arm aligned to the tripping means of a rotating plate. Linked to the rotating plate is a motor which, in turn, is connected to a power source. A switch is positioned to be engaged by the target holder in its downward position.

The impact of a projectile against the target causes the target holder to nutate from an upward to a downward position, thereby opening the switch which, in turn, causes the rotating plate to gyrate. The tripping means of the rotating plate then engages the target holder's positioning arm causing the target holder to return to its upward position, thus closing the switch. It is, therefore, an object of this invention to provide an automatic resetting target device.

It is also an object of this invention to provide a device for interchangeable and reusable targets.

It is yet another object of this invention to provide a device with few moving parts such that it is relatively maintenance free.

It is still another object of this invention to provide a device with a protective housing such that it will not be damaged by stray projectiles.

It is still a further object of this invention to provide a device that is convenient to carry and place in position for target practice.

These and other objects will be more readily ascertainable to one skilled in the art by reference to the accompanying drawing and exemplary embodiments that follow.

BRIEF DESCRIPTION OF THE DRAWING(S)

DETAILED DESCRIPTION OF THE PREFERRED EMBODIMENT(S)

Figure 1:
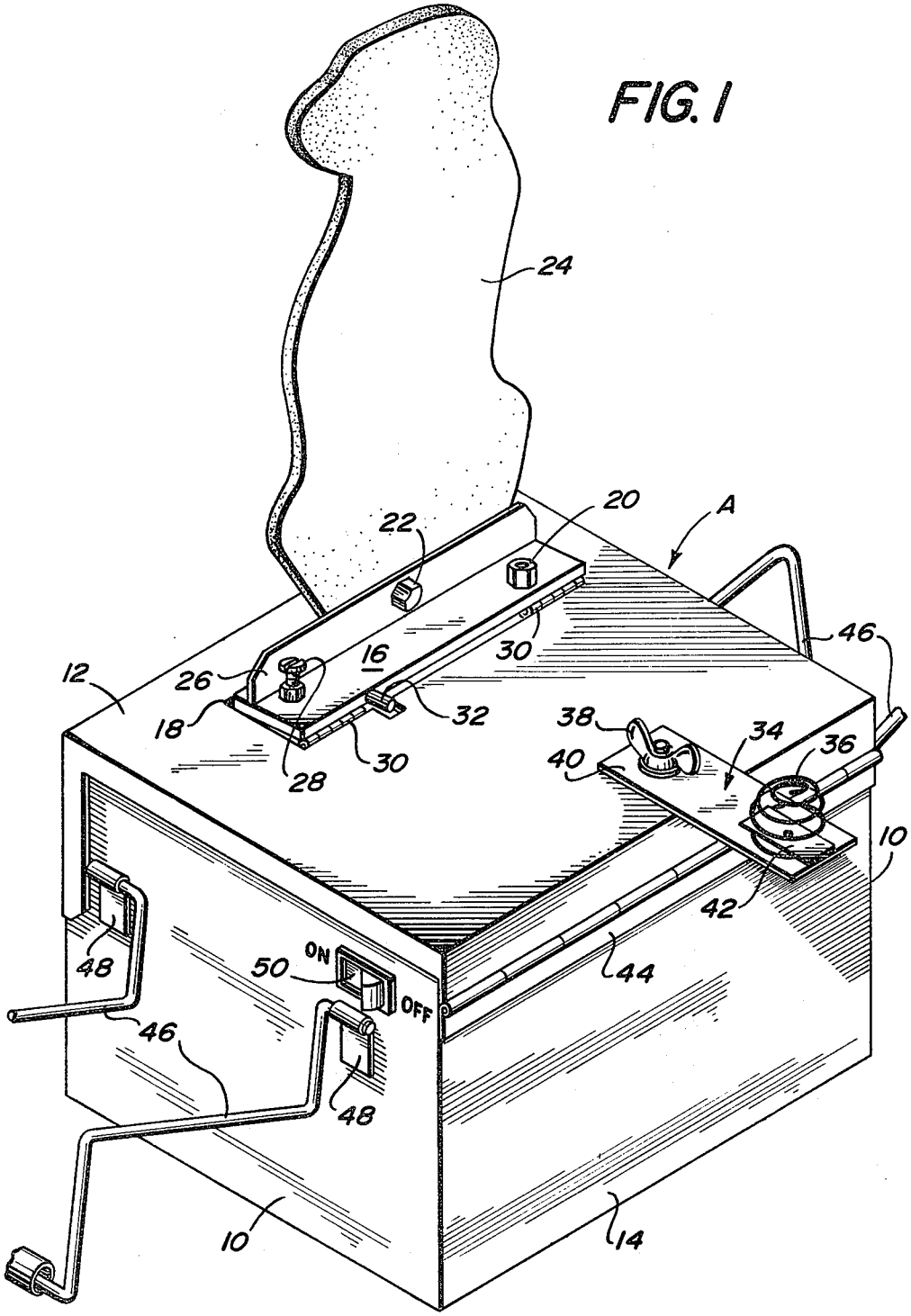
FIG. 1 depicts the device in oblique perspective ready for use with target holder and spring rest.

Referring now to the drawings and more particularly to FIG. 1, the target device is shown with a target in an upward position including housing A with side wall 10, lid 12 and back wall 14. Lid 12 shows target holder 16 protruding through aperture 18. Target holder 16 contains bolt 20 for securing positioning arm 60 (not shown in this Figure) and wing nut 22 for securing target 24 to mounting bracket 26 and engaging arm 32 (also described in more detail with reference to subsequent Figures). Screw 28 serves as an adjusting means for the angle of target 24. Hinges 30 allow for the nutating action of target holder 16.

Spring rest 34 consists of a rectangular plate 40 containing a helical coil spring 36 with attaching means 42 and wing nut 38 to aid in moving spring rest 34. Spring rest 34 is used to support target 24 in a downward position.

Also shown in FIG. 1 are back wall 14, attached to lid 12 by back hinge 44. Additionally, handles 46, described in more detail subsequently, are shown journaled in brackets 48. Power switch 50 is mounted on side wall 10.

Figures 2, 3:
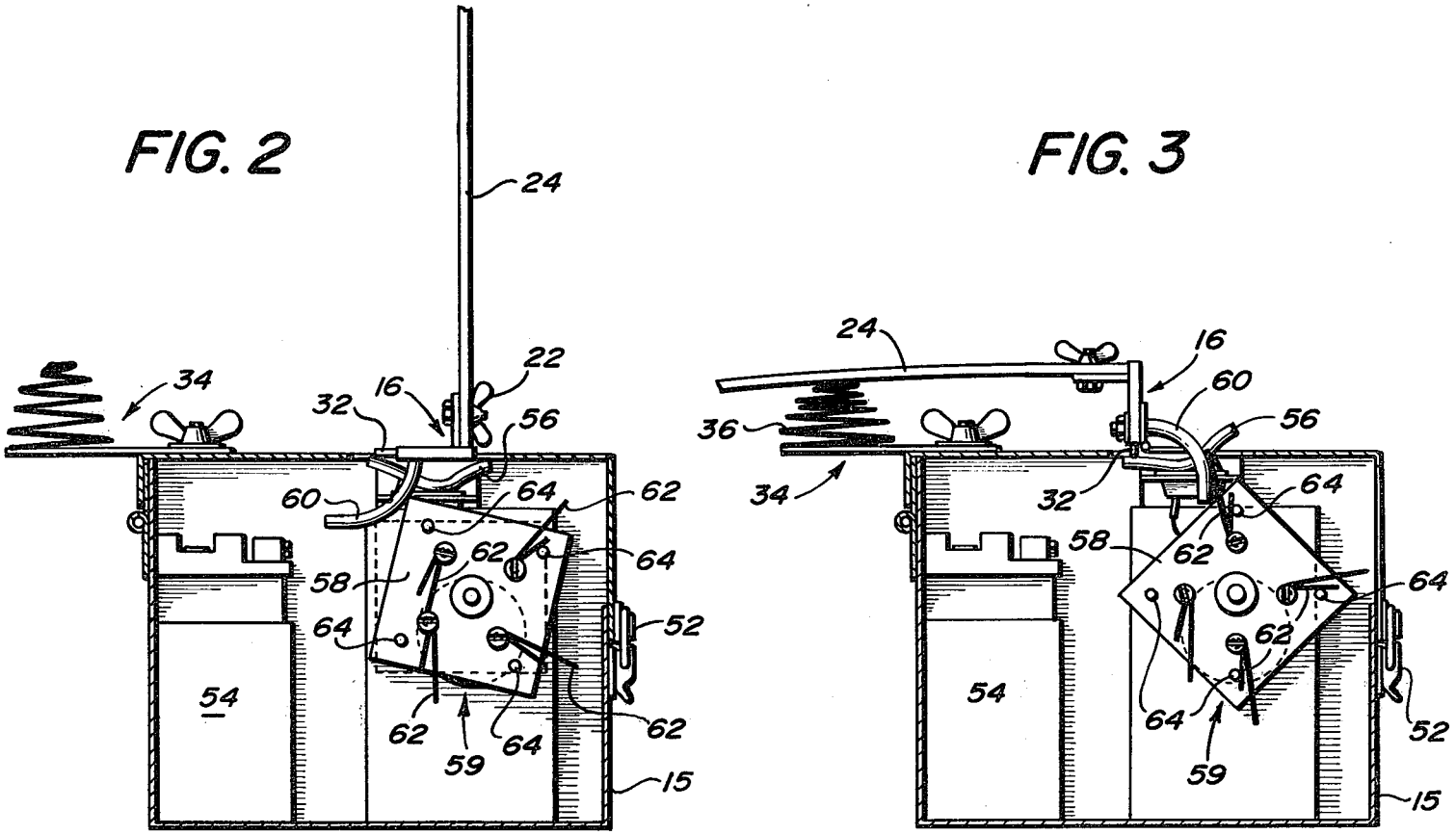
FIG. 2 is a cross section through the side of housing with the target in upward position.
FIG. 3 is a cross section through the side of housing with the target in downward position.

Referring now to FIG. 2, target holder 26 and spring rest 34 of the preferred embodiment of the invention are depicted as in FIG. 1. Locking means 52 is shown securing lid 12 to front 15. DC battery 54 is depicted as the power source. Engaging arm 32 is shown in its nonoperating, horizontal position so that normally open switch 56 is open, therefore causing no gyration of rotating plate 58 or engagement with positioning arm 60. Tripping means 59 on rotating plate 58 is shown as a plurality of spring leaves 62 and associated pins 64, each spring leaf 62 in alignment with its associated pin 64. Rotary plate 58 is linked to a motor through a gear reduction box, both of which are not shown.

Referring now to FIG. 3, target holder 16 is in a downward position with helical coil 36 of spring rest 34 supporting target 24. Engaging arm 32 is shown in its operating, vertical position so that normally open switch 56 is closed by the downward position of target holder 16, therefore causing gyration of rotating plate 58 which first causes one spring leaf 62 to contact and be detained between positioning arm 60 and an advancing associated pin 64 until the tension of spring leaf 62 is increased sufficiently to overcome the inertia of positioning arm 60, thereby lifting target holder 16 to upward position as was shown in FIG. 2.

Figure 4:
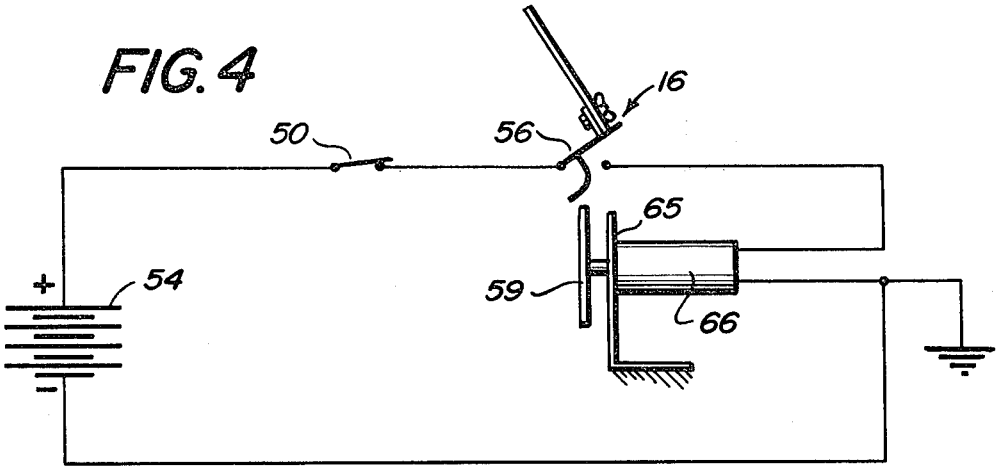
FIG. 4 is a diagramatic representation of the wiring of the device of the invention.

Referring now to FIG. 4, a wiring diagram of the invention is illustrated in which incoming current from DC battery 54 passes through power switch 50 to normally open switch 56 (now shown closing) to motor 66. Motor 66, through gear reduction box 65, causes tripping means 59 to be activated and come in contact with positioning arm 60 causing target holder 16 to again upright as discussed in FIGS. 2 and 3. The upright position of target holder 16 causes normally open switch 56 to open, thus breaking the circuit.

Figure 5:
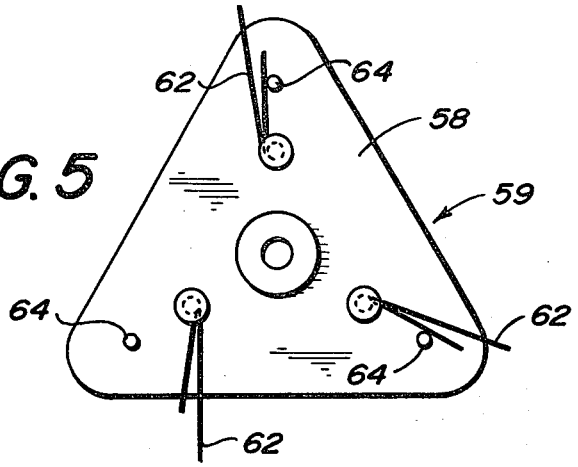
FIG. 5 is an alternate embodiment of the rotating plate.

FIG. 5 illustrates an alternate embodiment of the invention showing a triangular rotating plate 58 with three spring leaves 62 and three associated pins 64 which causes a slower resetting of target holder than the preferred embodiment shown in FIGS. 2 and 3.

Figure 6:
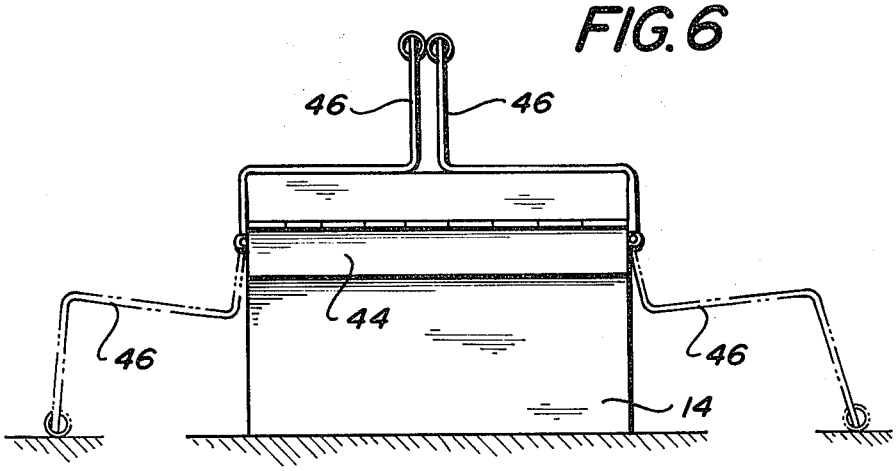
FIG. 6 is a back view showing handles in a carrying position and again in phantom for operational use.

Referring now to FIG. 6, a back view of the device is shown with handles 46 shown in carrying position and again in phantom for operational use.

There are many variations which may be practiced within the scope of this invention. For example, a DC battery is shown whereas a solenoid employing solid state circuitry could achieve the same action.

Square rotating plate 58 and triangular rotating plate 58 are shown with four and three spring leaves respectively, whereas any shape rotating plate with differing numbers of spring leaves would be acceptable by causing a variance in the resetting time.

The overall shape and dimensions of housing A are not critical to the invention although a generally parallelepipedal housing is shown.

Handles 46 and locking means 52 may be of any variety and type or may be omitted and are not meant to limit the scope of this invention.

Back hinge 44 and target holder hinge 30 may be of any variety and type. Back hinge 44 can be eliminated and lid 12 may be totally removable.

Spring rest 34 may be eliminated or designed in any way to support target 24 in its downward position.

The design of target holder 16 and its accessories (parts) bolt 20, wing nut 22, screw 28, engaging arm 32 and mounting bracket 26 may be varied and still within the scope of this invention.

Aperture 18 may be of any size and shape as long as it conforms to target holder 16.

Power switch 50 is shown and is merely preferred to permit extended use of DC battery 54, but is not necessary.

The device of this invention has many advantages. Chiefly among these is its automatic resetting of new or reusable targets.

Secondly, the device has a protective shatter-proof housing that protects the majority of its few parts. The limited number of parts makes it economical to manufacture and repair.

Thirdly, the device is easy to transport and set up because of its handles and housing. The device can be placed in an operative position without the aid of a support structure.

It should be noted that my invention is particularly suited for replacement of targets as they become worn. Rubber, such as that used in tires, provides a very good quality and and low cost target, although other material may be suitable.

In using my invention, the device may be exposed, but is of a size so that it is convenient to place it behind a log of sand filled tires. This would hide the device and protect it from gunshot damage while also lending an authentic aura for target practice.

Having now described and illustrated my invention, it is not intended that such description limit the scope of this invention, but rather that this invention be limited only by reasonable interpretation of the apended claims.

What is claimed is:

1. An automatic resetting target device to be used with aerial projectiles comprising:

(a) a generally parallelepipedal housing having two side walls, a back wall, a lid, a front wall, and a bottom, said lid including an aperture;

(b) a nutating target holder including a positioning arm mounted within said housing, said holder protruding through said aperture when said lid is closed;

(c) a rotating plate with tripping means in aligned position to engage said positioning arm during said plate's rotation;

(d) a motor linked to said rotating plate and operatively connected to a power source by wiring means; and, (e) a normally open switch which is closed and activated only when said target holder is in its downward position;

whereby, when the impact of a projectile against a target causes said target holder to nutate from its upward to a downward position, said normally open switch is closed and said motor gyrates said rotary plate so that said tripping means engages said positioning arm causing said target to again be upright and said normally open switch to break the circuit.

2. A device according to claim 1 wherein said tripping means includes a plurality of spring leaves mounted on said plate, each of said spring leaves associated with a pin mounted on said plate so that when said target holder is in a downward position, the gyration of said rotating plate first causes one of said spring leaves to contact and be detained between said positioning arm and its advancing associated pin until said spring leaf's tension is increased sufficiently to overcome said positioning arm's inertia, thereby lifting said target holder to an upright position.

3. A device according to claim 2 wherein said rotating plate is triangular in shape and includes three of said spring leaves, each of said spring leaves aligned with one of said associated pins.

4. A device according to claim 2 wherein said rotating plate is rectangular in shape and includes four of said spring leaves, each of said spring leaves aligned with one of said associated pins.

5. A device according to claim 1 wherein said linkage between said rotary plate and said motor includes a gear reduction box.

6. A device according to claim 1 wherein said target holder includes mounting means to permit removal, exchange and replacement of a target.

7. A device according to claim 1 wherein said wiring means includes a power switch mounted on said housing.

8. A device according to claim 1 wherein said power source is a direct current battery.

9. A device according to claim 1 wherein said housing is constructed of non-shatterable materials.

10. A device according to claim 1 wherein said lid is hingeably attached to said housing back wall.

11. A device according to claim 1 wherein said housing includes locking means to secure said lid.

12. A device according to claim 1 wherein said lid includes a spring rest rotatably mounted thereon to permit storage in a retracting position and support for said falling target in a downward position.

13. A device according to claim 1 wherein said side walls include handle means for carrying said device.

* * * * *